US005211430A

United States Patent [19]

Chern

[11] Patent Number: 5,211,430

[45] Date of Patent: May 18, 1993

[54] HIDDEN LOCK FOR A JEWELRY BOX

[75] Inventor: Jauh-Hsiung Chern, Changhua Hsien, Taiwan

[73] Assignee: Song Ye Industrial Co., Ltd., Changhua Hsien, Taiwan

[21] Appl. No.: 920,632

[22] Filed: Jul. 28, 1992

[51] Int. Cl.[5] ..... E05C 19/02

[52] U.S. Cl. ..... 292/80; 220/323; 292/337; 292/DIG. 4

[58] Field of Search ..... 292/DIG. 4, 337, 80; 220/402, 264, 323, 326

[56] References Cited

U.S. PATENT DOCUMENTS

| | | | |
|---|---|---|---|
| 3,189,374 | 6/1965 | Mertes | 292/80 |
| 4,641,747 | 2/1987 | Mestdogh et al. | 292/DIG. 4 X |
| 5,050,922 | 9/1991 | Falcoff | 292/DIG. 4 X |

*Primary Examiner*—Richard E. Moore
*Attorney, Agent, or Firm*—Bacon & Thomas

[57] ABSTRACT

A hidden lock for a jewelry or treasure box which is equipped with a flexible metal wire having one end thereof projected from an opening disposed at the bottom of the front side of a lower case; and a lock plate having an M shaped recess disposed thereon being disposed on the inner surface of the lower case of the box for engagement with the projected end of the wire which can be slidably guided through the recess. The cover case is associated with the lower case by means of a pair of spring biased hinges so that the cover case can be automatically opened as the cover case is pushed downward, permitting the flexible metal wire to be disengaged with the M shaped recess of the lock plate. The M shaped recess having three turnings is particularly designed to have an increasingly raised and abruptly dropped surface disposed before each turning with a hooked stop formed at each turning thereof so that the projected wire can have easy access to the recess and slidably and limitedly travel therein and can be retained in place by the second, hooked stop so as to make the box locked; and the box can be opened by simply pressing down the cover case so as to permit the projected end of the metal wire to travel along the third raised and dropped surface and disengage with the M shaped recess.

3 Claims, 3 Drawing Sheets

HIDDEN LOCK FOR A JEWELRY BOX

BACKGROUND OF THE INVENTION

The present invention relates to a hidden lock for a jewelry or treasure box which is provided with a flexible metal wire having an end projected from an opening disposed at the bottom of the front side of a lower case of the box and a lock plate secured to the inner surface of front side of a cover case of the box. An M shaped recess disposed on the lock plate is able to be engaged with the projected end of the metal wire when the cover case is closed. The M shaped recess having three turnings is designed to have an increasingly raised and abruptly dropped surface before each turning thereof so to form a hooked stop thereat whereby the projected end of the metal wire is slidably guided in the recess and retained in place at each turning and can be limited to travel forward only. As the cover case is pushed downward, the projected end of the flexible metal wire is forced again to slide forward and is disengaged with the recess so as to permit the cover case to pop opened as a result of the actuation of a pair of spring biased hinges which couples the lower case to the cover case of the box.

There are many types of jewelry or treasure box designed in a fascinating and appealing manner so as to match with the luxury of the jewellery received therein. Most of the boxes are provided with a hidden lock in consideration of the integral beauty of the box.

SUMMARY OF THE INVENTION

Therefore, the primary object of the present invention is to provide a hidden lock adapted for use in a jewelry or treasure box which is intended to keep the integral beauty of the same.

Another object of the present invention is to provide a hidden lock for a jewelry or treasure box which is not visible externally and can be opened only through the actuation of the cover case of the box.

FIG. is a diagram showing the path of motion of the projected end of the metal wire when the cover case is pushed downward to make the same opened.

DETAILED DESCRIPTION OF THE PREFERRED EMBODIMENT

Figure 1:
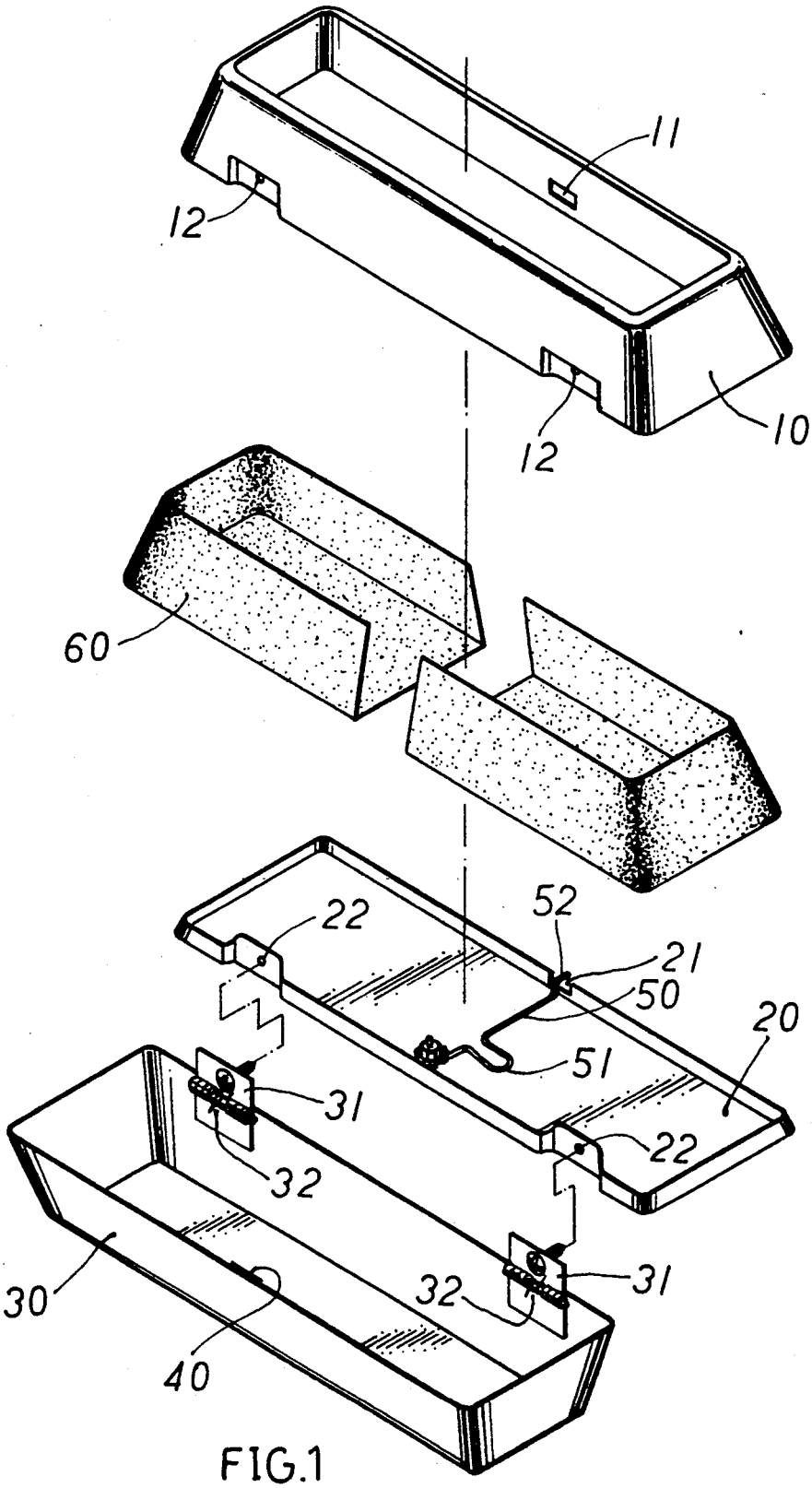
FIG. 1 is a perspective view of the exploded components of the present jewelry box with the flexible metal wire attached thereto.

Referring to FIG. 1, the present jewelry or treasure box is comprised of an open-bottomed lower case 10, a bottom lid 20, a cover case 30, a lock plate 40, a bent flexible metal wire 50 and an inner cushion member 60.

At the center of the bottom lid 20 is disposed the flexible metal wire 50 having a projected end 52 extended from a recessed cut 21 disposed on the edge of the bottom lid 20; near the other end of the metal wire 50 is provided with a bulged bending 51 which permits the wire to be flexibly actuated When pushed at the projected end; at the opposite edge of the recessed cut 21 are disposed a pair of spaced screw holes 22.

The lock plate 40 is secured to the inner surface of the front side of the cover case 30 and a pair of hinges 31 each actuated by a spring 32 are disposed on the opposite side of the cover 30. The front side of the bottomless lower case 10 is provided with a horizontally oriented opening 11 for the passage of the projected metal wire 50, and on the opposite side of the front side are disposed a pair of recessed cavities with a screw hole 115 defined therein respectively.

Figure 2:
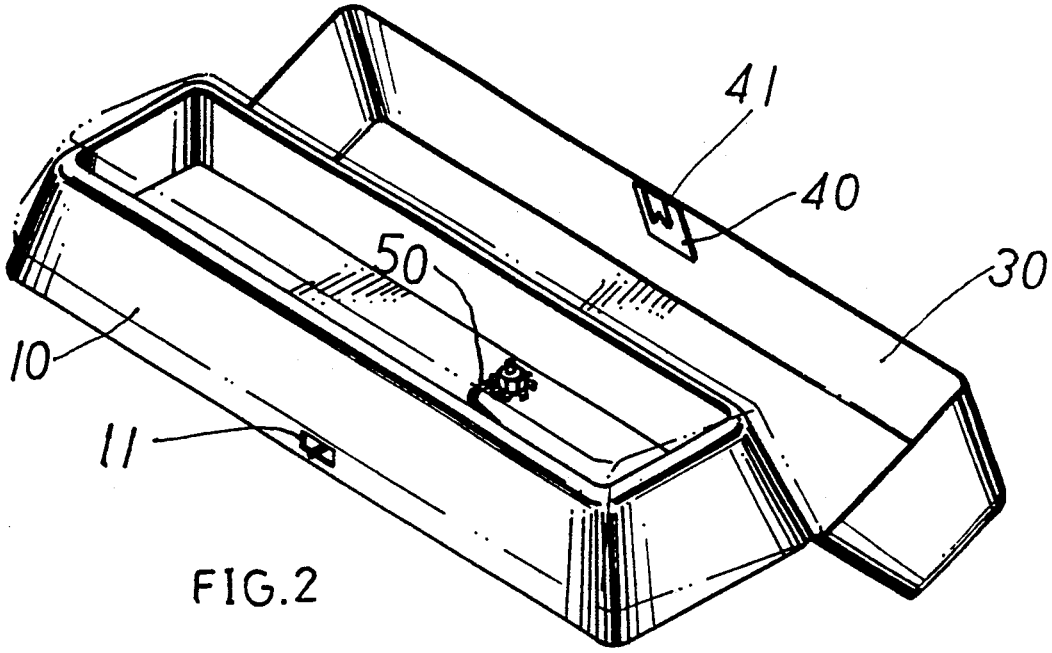
FIG. 2 is a pespective view of the assembled jewelry box with a hidden lock clearly illustrated.

In assembly, the inner cushion member 60 is first inserted into the bottomless lower case 10 and then the bottom lid 20 is attached to the underside of the lower case 10 with the opening 11 thereof in alignment with the recessed cut 21 of the bottom lid 20; and the screw holes 12 thereof in alignment with the screw holes 22 of the bottom lid 20; and the spring biased hinges 31 secured to the cover case 30 are associated with the bottom lid 20 and the lower case 10 by means of a pair of screws led through the screw holes 22 on the bottom lid 20 and the screw holes 12 on the lower case 10 so that the cover case 30 can be pivotally operated with respect to the lower case, as shown in FIG. 2.

Figure 3:
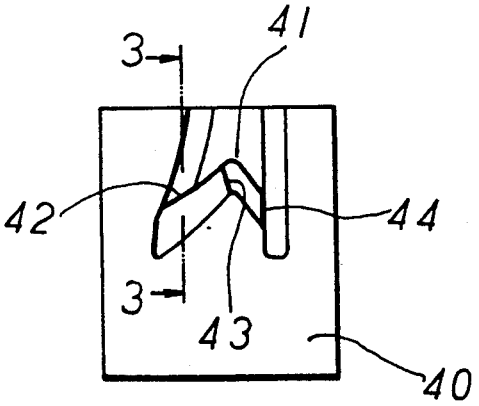
FIG. 3 is a diagram showing the structure of the M shaped recess of the lock plate.
Figure 3A:
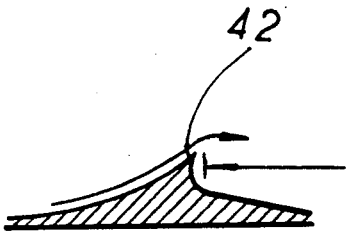
FIG. 3A is a sectional view of the recess taken along the line 3 —3 in FIG. 3 to illustrate the configuration of the surface of the M shaped recess.
Figure 4:
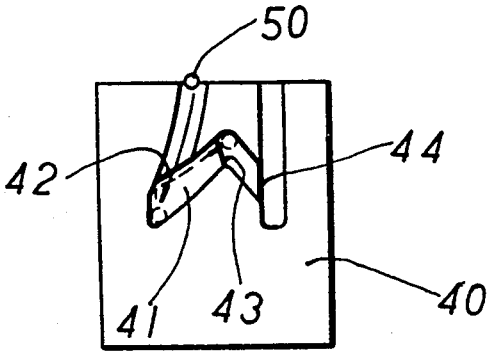
FIG. 4 is a diagram showing the path of the projected end of the flexible metal wire when the cover case is closed.
Figure 6:
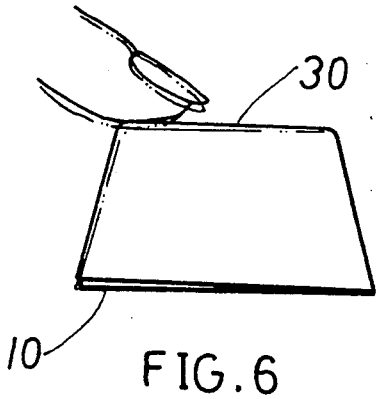
FIG. 6 a diagram showing the actuation of the cover case by a finger to open the box.
Figure 7:
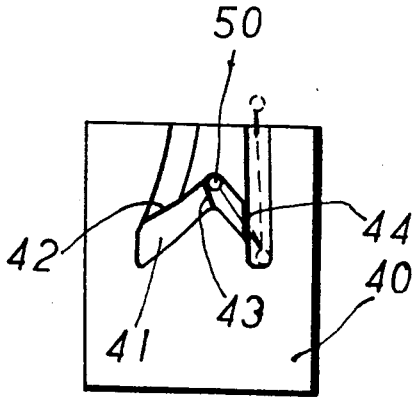
Figure 5:
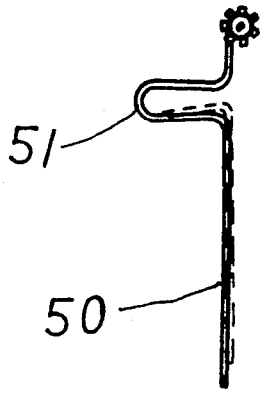
FIG. 5 is a diagram showing the structure of the flexible metal wire.

Referring to FIGS. 2, 3, the inner surface of the front side of the cover case 30 is disposed the lock plate 40 which is in corresponding alignment with the horizontally oriented opening 11 on the front side of the lower case 10. The lock plate 40 has an M shaped recess 41 which has three turnings and before each turning is disposed an increasingly raised and abruptly dropped surface respectively as shown in FIGS. 3, 3A. There are three hooked stops 42, 43, 44 formed at the turnings respectively that can prevent the projected end 52 of the metal wire 50 from reversely travelling . When the cover case 30 is pivotally shut, as shown in FIG. 4, the projected end 52 of the metal wire 50 sticking out of the opening 11 is flexibly led into the M shaped recess 41 due to the bulged bending 51 which permits the metal wire 50 to be resiliently actuated, as shown in FIG. 5, and guided all along the raised surface and abruptly drops into the hooked stop 42, and further pressing of the cover case 30 makes the projected end 52 move along the second raised surface and fall into the hooked stop 43 and retained in place thereat so as to get the jewelry box locked. To open the box, as shown in FIGS. 6, 7 the cover case 30 is downward pushed again to make the projected end 52 to travel further along the third raised surface between the hooked stops 43 and 44 and slide into the hooked stop 44, and the projected metal wire is free to travel all along therefrom and disengage with the M shaped recess and the box is accordingly opened.

It can be apparently seen that the hidden lock of the present invention is simply structured and effectively operated, and the hidden lock can prevent the whole appearance of a jewelry box from being spoiled by the attachment of a lock means.

I claim:

1. A hidden lock adapted for a jewelry or treasure box which is comprised of a bottomless lower case and an inner cushion member and a cover case and a bottom lid wherein said inner cushion member is inserted into said bottomless lower case with said bottom lid secured to the underside of said bottomless lower case and said cover case is associated with said lower case by a pair of spring biased hinges so as to permit said cover case to be pivotally opened or shut; said hidden lock comprising a flexible metal wire having a projected end extending out of a horizontally oriented opening disposed at the front side of said bottomless lower case and being disposed at the center of said bottom lid; and a lock plate secured to the inner surface of the front side of said cover case and being in corresponding alignment with said opening of said lower case and an M shaped recess being defined on said lock plate with said projected end of said metal wire limitedly traveling therein so as to make the box locked when said cover is shut and said projected end of said metal wire slides into said M shaped recess; and said projected end of said metal wire being able to be disengaged with said M shaped recess wire and said cover case being automatically opened due to the exertion of said spring biased hinges.

2. A hidden lock for a jewelry or treasure box as claimed in claim 1 wherein said flexible metal wire is provided with a bulged bending near the opposite end of said projected end so as to enable said metal wire to be flexibly operated when traveling in said M shaped recess when said cover case is closed.

3. A hidden lock for a jewelry or treasure box as claimed in claim 1 wherein said M shaped recess has three turnings and an increasingly raised and abruptly dropped surface is defined before each turning so as to form three hooked stops whereby said projected end of said metal wire can flexibly travel only forward without reversely moving and is retained in place by said second hooked stop after traveling the first and second raised and dropped surfaces, and said projected end of said metal wire can further travel along the third raised and dropped surface and finally disengage with said M shaped recess of said lock plate once said locked cover case is pushed downward again so as to permit said cover case to be automatically opened due to the actuation of said spring biased hinges.

* * * * *